US012185756B2

(12) United States Patent
Moloney

(10) Patent No.: US 12,185,756 B2
(45) Date of Patent: Jan. 7, 2025

(54) ATOMIZER ENCLOSURE FOR A VAPOR PROVISION SYSTEM

(71) Applicant: Nicoventures Trading Limited, London (GB)

(72) Inventor: Patrick Moloney, London (GB)

(73) Assignee: NICOVENTURES TRADING LIMITED, London (GB)

( * ) Notice: Subject to any disclaimer, the term of this patent is extended or adjusted under 35 U.S.C. 154(b) by 603 days.

(21) Appl. No.: 17/439,790

(22) PCT Filed: Mar. 11, 2020

(86) PCT No.: PCT/GB2020/050587
§ 371 (c)(1),
(2) Date: Sep. 15, 2021

(87) PCT Pub. No.: WO2020/188245
PCT Pub. Date: Sep. 24, 2020

(65) Prior Publication Data

US 2022/0125107 A1 Apr. 28, 2022

(30) Foreign Application Priority Data

Mar. 15, 2019 (GB) ..... 1903538

(51) Int. Cl.
*A24F 40/42* (2020.01)
*A24F 40/46* (2020.01)
(Continued)

(52) U.S. Cl.
CPC ..... *A24F 40/42* (2020.01); *A24F 40/46* (2020.01); *A24F 40/485* (2020.01); *A24F 40/70* (2020.01)

(58) Field of Classification Search
CPC ..... A24F 40/42; A24F 40/70; A24F 40/485; A24F 40/46
(Continued)

(56) References Cited

U.S. PATENT DOCUMENTS 8,794,231 B2 8/2014 Thorens et al.
9,308,336 B2 4/2016 Newton
(Continued)

FOREIGN PATENT DOCUMENTS

CN 201146824 Y 11/2008
CN 203828068 U * 9/2014 ..... A24F 47/008
(Continued)

OTHER PUBLICATIONS

"International Preliminary Report on Patentability received for PCT Patent Application No. PCT/GB2020/050587, mailed on Jun. 23, 2021".
(Continued)

*Primary Examiner* — Peter G Leigh
(74) *Attorney, Agent, or Firm* — Husch Blackwell

(57) ABSTRACT

An enclosure is provided for at least partially surrounding an atomizer of a vapor provision system to define an aerosol chamber around the atomizer, where the atomizer is located at least partially externally to outer dimensions of a reservoir for aerosolizable substrate material to be aerosolised by the atomizer, where the enclosure comprises at least one wall defining the aerosol chamber; a joining portion by which the enclosure is enabled to extend outwardly from a housing defining the reservoir; one or more openings in the at least one wall to allow aerosolizable substrate material to enter the aerosol chamber from the reservoir and aerosol to exit the aerosol chamber; and one or more apertures in the at least one wall to allow air to enter the aerosol chamber.

20 Claims, 5 Drawing Sheets

(51) Int. Cl.
*A24F 40/485* (2020.01)
*A24F 40/70* (2020.01)

(58) Field of Classification Search
USPC ..... 131/329
See application file for complete search history.

(56) References Cited

U.S. PATENT DOCUMENTS

| | | | | |
|---|---|---|---|---|
| 9,497,997 | B2 | 11/2016 | Wu | |
| 9,596,887 | B2 | 3/2017 | Newton | |
| 9,861,135 | B2 * | 1/2018 | Chen | A24F 40/44 |
| 9,888,720 | B2 * | 2/2018 | Chen | H05B 3/16 |
| 9,999,255 | B2 | 6/2018 | Li et al. | |
| 10,004,263 | B2 | 6/2018 | Liu | |
| 10,045,568 | B2 | 8/2018 | Monsees et al. | |
| 10,070,668 | B2 | 9/2018 | Li et al. | |
| 10,076,139 | B2 | 9/2018 | Monsees et al. | |
| 10,881,141 | B2 | 1/2021 | Fraser et al. | |
| 11,259,570 | B2 | 3/2022 | Pan | |
| 2004/0060556 | A1 | 4/2004 | Halamish | |
| 2013/0284192 | A1 | 10/2013 | Peleg et al. | |
| 2014/0299138 | A1 | 10/2014 | Xiang | |
| 2014/0355969 | A1 | 12/2014 | Stern | |
| 2015/0216236 | A1 | 8/2015 | Bless et al. | |
| 2015/0245660 | A1 | 9/2015 | Lord | |
| 2015/0245669 | A1 | 9/2015 | Cadieux et al. | |
| 2015/0272217 | A1 * | 10/2015 | Chen | A24F 40/485 131/329 |
| 2015/0305406 | A1 | 10/2015 | Li et al. | |
| 2015/0328415 | A1 | 11/2015 | Minskoff et al. | |
| 2015/0342256 | A1 * | 12/2015 | Chen | H05B 3/16 392/404 |
| 2015/0342258 | A1 | 12/2015 | Chen | |
| 2016/0007655 | A1 | 1/2016 | Li et al. | |
| 2016/0095354 | A1 | 4/2016 | Wu | |
| 2016/0106153 | A1 | 4/2016 | Zhu | |
| 2016/0192708 | A1 * | 7/2016 | DeMeritt | H05B 3/40 392/390 |
| 2016/0316820 | A1 * | 11/2016 | Liu | A24F 40/485 |
| 2016/0338406 | A1 * | 11/2016 | Liu | H01R 13/17 |
| 2016/0345625 | A1 * | 12/2016 | Liu | A24F 40/50 |
| 2016/0360784 | A1 * | 12/2016 | Liu | H05B 1/0244 |
| 2016/0366937 | A1 * | 12/2016 | Liu | A24F 40/50 |
| 2016/0374401 | A1 | 12/2016 | Liu | |
| 2017/0071260 | A1 | 3/2017 | Li et al. | |
| 2017/0112193 | A1 | 4/2017 | Chen | |
| 2017/0119052 | A1 | 5/2017 | Williams et al. | |
| 2017/0143041 | A1 | 5/2017 | Batista et al. | |
| 2017/0202266 | A1 * | 7/2017 | Sur | A61M 11/041 |
| 2017/0224016 | A1 | 8/2017 | Reevell | |
| 2017/0224017 | A1 * | 8/2017 | Li | H05B 1/0244 |
| 2017/0273359 | A1 | 9/2017 | Liu | |
| 2017/0280771 | A1 | 10/2017 | Courbat et al. | |
| 2017/0280778 | A1 | 10/2017 | Force | |
| 2017/0340014 | A1 | 11/2017 | Batista et al. | |
| 2017/0360092 | A1 | 12/2017 | Althorpe et al. | |
| 2017/0367407 | A1 | 12/2017 | Althorpe et al. | |
| 2018/0084828 | A1 | 3/2018 | Phillips et al. | |
| 2018/0125117 | A1 * | 5/2018 | DeMeritt | A61M 15/002 |
| 2018/0132531 | A1 | 5/2018 | Sur et al. | |
| 2018/0213850 | A1 | 8/2018 | Brinkley et al. | |
| 2018/0242648 | A1 | 8/2018 | Dooly et al. | |
| 2018/0325171 | A1 * | 11/2018 | Zhu | A24F 40/60 |
| 2019/0269177 | A1 | 9/2019 | Liu et al. | |

FOREIGN PATENT DOCUMENTS

| | | | | |
|---|---|---|---|---|
| CN | 104114050 | A | 10/2014 | |
| CN | 203872997 | U * | 10/2014 | |
| CN | 105307519 | A | 2/2016 | |
| CN | 105394816 | A | 3/2016 | |
| CN | 106102491 | A | 11/2016 | |
| CN | 106136331 | A | 11/2016 | |
| CN | 106170215 | A | 11/2016 | |
| CN | 206119185 | U | 4/2017 | |
| CN | 106686995 | A | 5/2017 | |
| CN | 106998819 | A | 8/2017 | |
| CN | 107454883 | A | 12/2017 | |
| CN | 107865462 | A | 4/2018 | |
| CN | 108348711 | A | 7/2018 | |
| CN | 108430242 | A | 8/2018 | |
| CN | 108471813 | A | 8/2018 | |
| CN | 108778006 | A | 11/2018 | |
| EP | 2949228 | A2 | 12/2015 | |
| EP | 2965642 | A1 | 1/2016 | |
| EP | 3135139 | A1 | 3/2017 | |
| EP | 3158882 | A2 | 4/2017 | |
| EP | 2949228 | B1 * | 5/2017 | A24F 40/42 |
| EP | 3220987 | A1 | 9/2017 | |
| EP | 2950675 | B1 | 10/2017 | |
| JP | 2015519903 | A | 7/2015 | |
| JP | 2017501682 | A | 1/2017 | |
| JP | 2017504361 | A | 2/2017 | |
| KR | 20180123701 | A | 11/2018 | |
| RU | 2653675 | C1 | 5/2018 | |
| RU | 2673580 | C1 | 11/2018 | |
| WO | WO-2015127666 | A1 * | 9/2015 | A24F 47/008 |
| WO | WO-2015179002 | A2 * | 11/2015 | A24F 47/008 |
| WO | 2015189556 | A1 | 12/2015 | |
| WO | 2016010864 | A1 | 1/2016 | |
| WO | 2016061859 | A1 | 4/2016 | |
| WO | 2016079155 | A1 | 5/2016 | |
| WO | 2016092261 | A1 | 6/2016 | |
| WO | WO-2016106476 | A1 * | 7/2016 | A24F 47/00 |
| WO | 2016128562 | A1 | 8/2016 | |
| WO | 2017163050 | A1 | 9/2017 | |
| WO | WO-2017206189 | A1 * | 12/2017 | A24F 47/00 |
| WO | 2018054388 | A1 | 3/2018 | |
| WO | 2018072373 | A1 | 4/2018 | |
| WO | WO-2018094564 | A1 * | 5/2018 | A24F 40/42 |
| WO | WO-2019042331 | A1 * | 3/2019 | A24F 40/42 |

OTHER PUBLICATIONS

"International Preliminary Report on Patentability received for PCT Patent Application No. PCT/GB2020/050588, mailed on Sep. 30, 2021".

"International Search Report and Written Opinion received for PCT Patent Application No. PCT/GB2020/050587, mailed on Jun. 4, 2020".

"International Search Report and Written Opinion received for PCT Patent Application No. PCT/GB2020/050588, mailed on Sep. 18, 2020".

"Invitation to Pay Additional Fees received for PCT Patent Application No. PCT/GB2020/050588, mailed on Jun. 2, 2020".

"Notice of Allowance received for Chinese Patent Application No. 202080021689.X, mailed on May 2, 2024".

"Office Action received for Chinese Patent Application No. 202080021245.6, mailed on Jan. 5, 2024".

"Office Action received for Russian Patent Application No. 2021126950, mailed on May 24, 2022".

"Reason for Refusal received for Japanese Patent Application No. 2021-551779, mailed on Nov. 8, 2022".

"Reasons for Refusal received for Japanese Patent Application No. 2021-551537, mailed on Oct. 25, 2022".

* cited by examiner

ATOMIZER ENCLOSURE FOR A VAPOR PROVISION SYSTEM

CROSS-REFERENCE TO RELATED APPLICATIONS

This application is a National Phase entry of PCT Application No. PCT/GB2020/050587, filed Mar. 11, 2020, which application claims the benefit of priority to GB Application No. 1903538.5, filed Mar. 15, 2019, the entire disclosures of which are incorporated herein by reference.

TECHNICAL FIELD

The present disclosure relates to an atomizer enclosure for a vapour provision system, and a cartomizer for a vapour provision system and a vapour provision system comprising such an atomizer enclosure.

BACKGROUND

Many electronic vapour provision systems, such as e-cigarettes and other electronic nicotine delivery systems that deliver nicotine via vaporised liquids, are formed from two main components or sections, namely a cartridge or cartomizer section and a control unit (battery section). The cartomizer generally includes a reservoir of liquid and an atomizer for vaporising the liquid. These parts may collectively be designated as an aerosol source. The atomizer generally combines the functions of porosity or wicking and heating in order to transport liquid from the reservoir to a location where it is heated and vaporised. For example, it may be implemented as an electrical heater, which may be a resistive wire formed into a coil or other shape for resistive (Joule) heating or a susceptor for induction heating, and a porous element with capillary or wicking capability in proximity to the heater which absorbs liquid from the reservoir and carries it to the heater. The control unit generally includes a battery for supplying power to operate the system. Electrical power from the battery is delivered to activate the heater, which heats up to vaporise a small amount of liquid delivered from the reservoir. The vaporised liquid is then inhaled by the user.

The components of the cartomizer can be intended for short term use only, so that the cartomizer is a disposable component of the system, also referred to as a consumable. In contrast, the control unit is typically intended for multiple uses with a series of cartomizers, which the user replaces as each expires. Consumable cartomizers are supplied to the consumer with a reservoir pre-filled with liquid, and intended to be disposed of when the reservoir is empty. For convenience and safety, the reservoir is sealed and designed not to be easily refilled, since the liquid may be difficult to handle. It is simpler for the user to replace the entire cartomizer when a new supply of liquid is needed.

In this context, it is desirable that cartomizers are straightforward to manufacture and comprise few parts. They can hence be efficiently manufactured in large quantities at low cost with minimum waste. Cartomizers of a simple design are hence of interest.

SUMMARY

According to a first aspect of some embodiments described herein, there is provided an enclosure for at least partially surrounding an atomizer of a vapour provision system to define an aerosol chamber around the atomizer, where the atomizer is located at least partially externally to outer dimensions of a reservoir for aerosolizable substrate material to be aerosolised by the atomizer, the enclosure comprising: at least one wall defining the aerosol chamber; a joining portion by which the enclosure is enabled to extend outwardly from a housing defining the reservoir; one or more openings in the at least one wall to allow aerosolizable substrate material to enter the aerosol chamber from the reservoir and aerosol to exit the aerosol chamber; and one or more apertures in the at least one wall to allow air to enter the aerosol chamber.

According to a second aspect of some embodiments described herein, there is provided a cartridge for a vapour provision system, comprising an enclosure according to the first aspect and a reservoir for aerosolizable substrate material from which the enclosure extends.

According to a third aspect of some embodiments described herein, there is provided a vapour provision system or a cartridge for a vapour provision system, comprising an enclosure according to the first aspect, a reservoir containing aerosolizable substrate material from which the enclosure extends, a mouthpiece with an outlet for the inhalation of aerosol formed from the aerosolizable substrate material, a first sealing layer disposed over the one or more apertures of the enclosure, and a second sealing layer disposed over the outlet of the mouthpiece, the sealing layers configured for removal by a user before use of the vapour provision system or the cartridge.

According to a fourth aspect of some embodiments described herein, there is provided a cartridge according to the second aspect or a vapour provision system according to the third aspect, comprising a housing defining the reservoir to which the enclosure is coupled at a join secured by adhesive or welding.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an atomizer enclosure or a vapour provision system including an atomizer enclosure may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which:

FIGS. 4, 4(A), 4(B) and 4(C) show simplified schematic cross-sectional views of a further example cartomizer in which aspects of the disclosure can be implemented;

DETAILED DESCRIPTION

Figure 1:
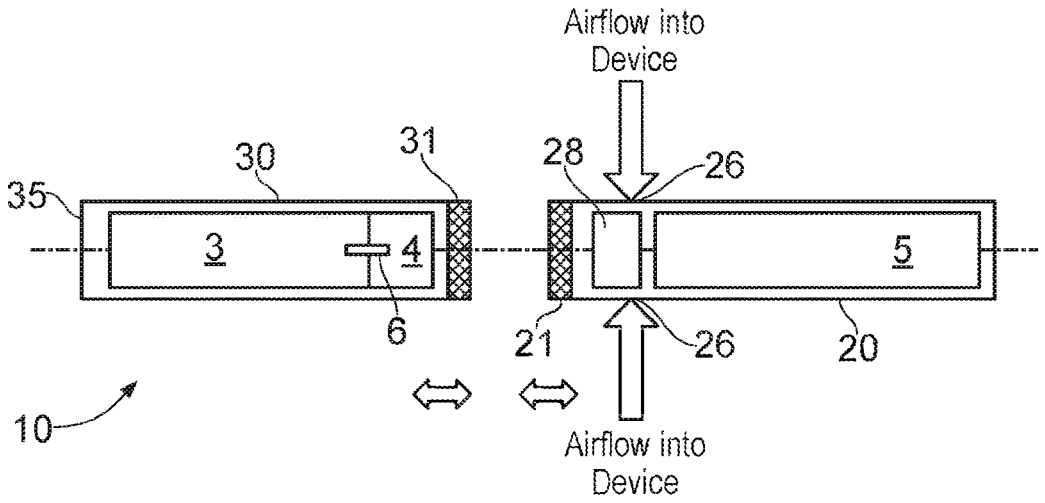
FIG. 1 shows a cross-section through an example e-cigarette comprising a cartomizer and a control unit.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapour provision systems, such as e-cigarettes. Throughout the following description the terms "e-cigarette" and "electronic cigarette" may sometimes be used; however, it will be appreciated these terms may be used interchangeably with aerosol (vapour) provision system or device. The systems are intended to generate an inhalable aerosol by vaporisation of a substrate in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The term "aerosolizable substrate material" as used herein is intended to refer to substrate materials which can form an aerosol, either through the application of heat or some other means. The term "aerosol" may be used interchangeably with "vapour".

As used herein, the term "component" is used to refer to a part, section, unit, module, assembly or similar of an electronic cigarette or similar device that incorporates several smaller parts or elements, possibly within an exterior housing or wall. An electronic cigarette may be formed or built from one or more such components, and the components may be removably or separably connectable to one another, or may be permanently joined together during manufacture to define the whole electronic cigarette. The present disclosure is applicable to (but not limited to) systems comprising two components separably connectable to one another and configured, for example, as an aerosolizable substrate material carrying component holding liquid or another aerosolizable substrate material (a cartridge, cartomizer or consumable), and a control unit having a battery for providing electrical power to operate an element for generating vapour from the substrate material. For the sake of providing a concrete example, in the present disclosure, a cartomizer is described as an example of the aerosolizable substrate material carrying portion or component, but the disclosure is not limited in this regard and is applicable to any configuration of aerosolizable substrate material carrying portion or component. Also, such a component may include more or fewer parts than those included in the examples.

The present disclosure is particularly concerned with vapour provision systems and components thereof that utilise aerosolizable substrate material in the form of a liquid or a gel which is held in a reservoir, tank, container or other receptacle comprised in the system. An arrangement for delivering the substrate material from the reservoir for the purpose of providing it for vapour/aerosol generation is included. The terms "liquid", "gel", "fluid", "source liquid", "source gel", "source fluid" and the like may be used interchangeably with "aerosolizable substrate material" and "substrate material" to refer to aerosolizable substrate material that has a form capable of being stored and delivered in accordance with examples of the present disclosure.

FIG. 1 is a highly schematic diagram (not to scale) of a generic example aerosol/vapour provision system such as an e-cigarette 10, presented for the purpose of showing the relationship between the various parts of a typical system and explaining the general principles of operation. The e-cigarette 10 has a generally elongate shape in this example, extending along a longitudinal axis indicated by a dashed line, and comprises two main components, namely a control or power component, section or unit 20, and a cartridge assembly or section 30 (sometimes referred to as a cartomizer or clearomizer) carrying aerosolizable substrate material and operating as a vapour-generating component.

The cartomizer 30 includes a reservoir 3 containing a source liquid or other aerosolizable substrate material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavourings. Nicotine-free source liquid may also be used, such as to deliver flavouring. A solid substrate (not illustrated), such as a portion of tobacco or other flavour element through which vapour generated from the liquid is passed, may also be included. The reservoir 3 has the form of a storage tank, being a container or receptacle in which source liquid can be stored such that the liquid is free to move and flow within the confines of the tank. For a consumable cartomizer, the reservoir 3 may be sealed after filling during manufacture so as to be disposable after the source liquid is consumed, otherwise, it may have an inlet port or other opening through which new source liquid can be added by the user. The cartomizer 30 also comprises an electrically powered heating element or heater 4 located externally of the reservoir tank 3 for generating the aerosol by vaporisation of the source liquid by heating. A liquid transfer or delivery arrangement (liquid transport element) such as a wick or other porous element 6 may be provided to deliver source liquid from the reservoir 3 to the heater 4. A wick 6 may have one or more parts located inside the reservoir 3, or otherwise be in fluid communication with the liquid in the reservoir 3, so as to be able to absorb source liquid and transfer it by wicking or capillary action to other parts of the wick 6 that are adjacent or in contact with the heater 4. This liquid is thereby heated and vaporised, to be replaced by new source liquid from the reservoir for transfer to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or atomizer assembly, and the reservoir with its source liquid plus the atomizer may be collectively referred to as an aerosol source. Other terminology may include a liquid delivery assembly or a liquid transfer assembly, where in the present context these terms may be used interchangeably to refer to a vapour-generating element (vapour generator) plus a wicking or similar component or structure (liquid transport element) that delivers or transfers liquid obtained from a reservoir to the vapour generator for vapour/aerosol generation. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). In an electrical or electronic device, the vapour generating element may be an electrical heating element that operates by ohmic/resistive (Joule) heating or by inductive heating. In general, therefore, an atomizer can be considered as one or more elements that implement the functionality of a vapour-generating or vaporising element able to generate vapour from source liquid delivered to it, and a liquid transport or delivery element able to deliver or transport liquid from a reservoir or similar liquid store to the vapour generator by a wicking action/capillary force. An atomizer is typically housed in a cartomizer component of a vapour generating system. In some designs, liquid may be dispensed from a reservoir directly onto a vapour generator with no need for a distinct wicking or capillary element. Embodiments of the disclosure are applicable to all and any such configurations which are consistent with the examples and description herein.

Returning to FIG. 1, the cartomizer 30 also includes a mouthpiece or mouthpiece portion 35 having an opening or air outlet through which a user may inhale the aerosol generated by the atomizer 4.

The power component or control unit 20 includes a cell or battery 5 (referred to herein after as a battery, and which may be re-chargeable) to provide power for electrical components of the e-cigarette 10, in particular to operate the heater 4. Additionally, there is a controller 28 such as a printed circuit board or other electronics or circuitry for generally controlling the e-cigarette. The control electronics/circuitry 28 operates the heater 4 using power from the battery 5 when vapour is required, for example in response to a signal from an air pressure sensor or air flow sensor (not shown) that detects an inhalation on the system 10 during which air enters through one or more air inlets 26 in the wall of the control unit 20. When the heating element 4 is operated, the heating element 4 vaporises source liquid delivered from the reservoir 3 by the liquid delivery element 6 to generate the aerosol, and this is then inhaled by a user through the opening in the mouthpiece 35. The aerosol is carried from the aerosol source to the mouthpiece 35 along one or more air channels (not shown) that connect the air inlet 26 to the aerosol source to the air outlet when a user inhales on the mouthpiece 35.

The control unit (power section) 20 and the cartomizer (cartridge assembly) 30 are separate connectable parts detachable from one another by separation in a direction parallel to the longitudinal axis, as indicated by the double-ended arrows in FIG. 1. The components 20, 30 are joined together when the device 10 is in use by cooperating engagement elements 21, 31 (for example, a screw or bayonet fitting) which provide mechanical and in some cases electrical connectivity between the power section 20 and the cartridge assembly 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the cartomizer 30. An inductive work coil can be housed in the power section 20 and supplied with power from the battery 5, and the cartomizer 30 and the power section 20 shaped so that when they are connected, there is an appropriate exposure of the heater 4 to flux generated by the coil for the purpose of generating current flow in the material of the heater. Inductive heating arrangements are discussed further below. The FIG. 1 design is merely an example arrangement, and the various parts and features may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. In other examples, the system 10 may be unitary, in that the parts of the control unit 20 and the cartomizer 30 are comprised in a single housing and cannot be separated. Embodiments and examples of the present disclosure are applicable to any of these configurations and other configurations of which the skilled person will be aware.

Figure 2:
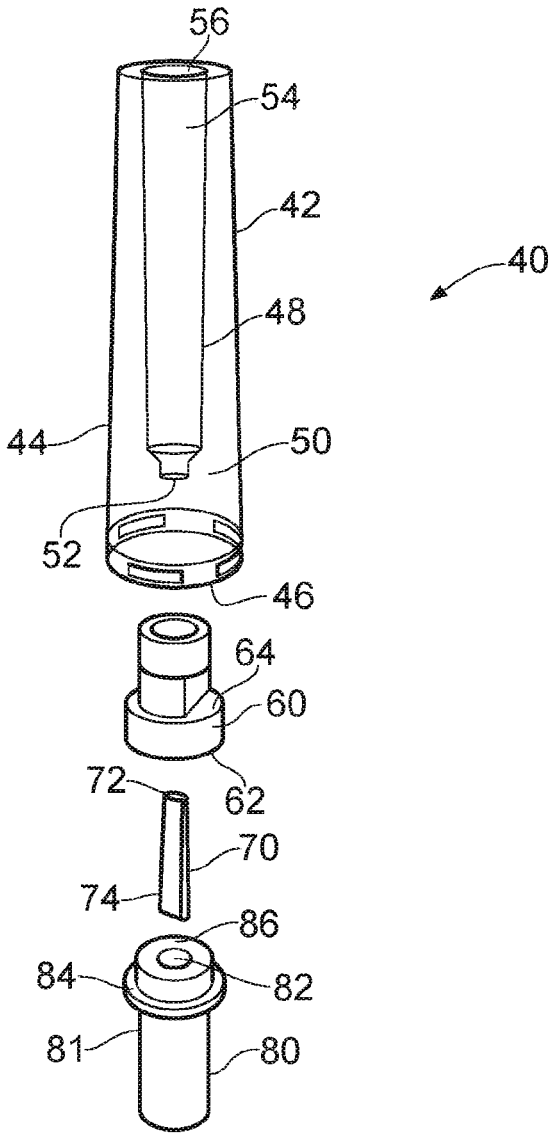
FIG. 2 shows an external perspective exploded view of an example cartomizer in which aspects of the disclosure can be implemented.

FIG. 2 shows an external perspective view of parts which can be assembled to form a cartomizer according to an example of the present disclosure. The cartomizer 40 comprises four parts only, which can be assembled by being pushed or pressed together if appropriately shaped. Hence, fabrication can be made very simple and straightforward.

A first part is a housing 42 that defines a reservoir for holding aerosolizable substrate material (hereinafter referred to as a substrate or a liquid, for brevity). The housing 42 has a generally tubular shape, which in this example has a circular cross-section, and comprises a wall or walls shaped to define various parts of the reservoir and other items. A cylindrical outer side wall 44 is open at its lower end at an opening 46 through which the reservoir may be filled with liquid, and to which parts can be joined as described below, to close/seal the reservoir and also enable an outward delivery of the liquid for vaporisation. This defines an exterior or external volume or dimensions of the reservoir. References herein to elements or parts lying or being located externally to the reservoir are intended to indicate that the part is outside or partially outside the region bounded or defined by this outer wall 44 and its upper and lower extent and edges or surfaces.

A cylindrical inner wall 48 is concentrically arranged within the outer side wall 44. This arrangement defines an annular volume 50 between the outer wall 44 and the inner wall 48 which is a receptacle, cavity, void or similar to hold liquid, in other words, the reservoir. The outer wall 44 and the inner wall 48 are connected together (for example by a top wall or by the walls tapering towards one another) in order to close the upper edge of the reservoir volume 50. The inner wall 48 is open at its lower end at an opening 52, and also at its upper end. The tubular inner space bounded by the inner wall is an air flow passage or channel 54 that, in the assembled system, carries generated aerosol from an atomizer to a mouthpiece outlet of the system for inhalation by a user. The opening 56 at the upper end of the inner wall 48 can be the mouthpiece outlet, configured to be comfortably received in the user's mouth, or a separate mouthpiece part can be coupled on or around the housing 42 having a channel connecting the opening 56 to a mouthpiece outlet.

The housing 42 may be formed from moulded plastic material, for example by injection moulding. In the example of FIG. 2, it is formed from transparent material; this allows the user to observe a level or amount of liquid in the reservoir 44. The housing might alternatively be opaque, or opaque with a transparent window through which the liquid level can be seen. The plastic material may be rigid in some examples.

A second part of the cartomizer 40 is a flow directing member 60, which in this example also has a circular cross-section, and is shaped and configured for engagement with the lower end of the housing 42. The flow directing member 60 is effectively a bung, and is configured to provide a plurality of functions. When inserted into the lower end of the housing 42, it couples with the opening 46 to close and seal the reservoir volume 50 and couples with the opening 52 to seal off the air flow passage 54 from the reservoir volume 50. Additionally, the flow directing member 60 has at least one channel passing through it for liquid flow, which carries liquid from the reservoir volume 50 to a space external to the reservoir which acts as an aerosol chamber where vapour/aerosol is generated by heating the liquid. Also the flow directing member 60 has at least one other channel passing through it for aerosol flow, which carries the generated aerosol from the aerosol chamber space to the air flow passage 54 in the housing 42, so that it is delivered to the mouthpiece opening for inhalation.

Also, the flow directing member 60 may be made from a flexible resilient material such as silicone so that it can be easily engaged with the housing 46 via a friction fit. Additionally, the flow directing member has a socket or similarly-shaped formation (not shown) on its lower surface 62, opposite to the upper surface or surfaces 64 which engages with the housing 42. The socket receives and supports an atomizer 70, being a third part of the cartomizer 40.

The atomizer 70 has an elongate shape with a first end 72 and a second end 74 oppositely disposed with respect to its elongate length. In the assembled cartomizer, the atomizer is mounted at its first end 72 which pushes into the socket of the flow directing member 60 in a direction towards the reservoir housing 42. The first end 72 is therefore supported by the flow directing member 60, and the atomizer 70 extends lengthwise outwardly from the reservoir substantially along the longitudinal axis defined by the concentrically shaped parts of the housing 42. The second end 74 of the atomizer 70 is not mounted, and is left free. Accordingly, the atomizer 70 is supported in a cantilevered manner extending outwardly from the exterior bounds of the reservoir. The atomizer 70 performs a wicking function and a heating function in order to generate aerosol, and may comprise any of several configurations of an electrically resistive heater portion configured to act as an induction susceptor, and a porous portion configured to wick liquid from the reservoir to the vicinity of the heater.

A fourth part of the cartomizer 40 is an enclosure or shroud 80. Again, this has a circular cross-section in this example. It comprises a cylindrical side wall 81 closed by an optional base wall to define a central hollow space or void 82. The upper rim 84 of the side wall 81, around an opening 86, is shaped to enable engagement of the enclosure 80 with reciprocally shaped parts on the flow directing member 60 or on the reservoir housing 42 so that the enclosure 80 can be coupled to the flow directing member 60 or the reservoir housing 42 once the atomizer 70 is fitted into the socket on the flow directing member 60. The enclosure 80 is therefore coupled directly or indirectly to the reservoir housing 42 so as to extend outwardly therefrom. The flow directing member 60 acts as a cover to close the central space 82, and this space 82 creates an aerosol chamber in which the atomizer 70 is disposed. The opening 86 allows communication with the liquid flow channel and the aerosol flow channel in the flow directing member 60 so that liquid can be delivered to the atomizer and generated aerosol can be removed from the aerosol chamber. In order to enable a flow of air through the aerosol chamber to pass over the atomizer 70 and collect the vapour such that it becomes entrained in the air flow to form an aerosol, the wall or walls 81 of the enclosure 80 have one or more openings or perforations to allow air to be drawn into the aerosol chamber when a user inhales via the mouthpiece opening of the cartomizer.

The enclosure 80 may be formed from a plastics material, such as by injection moulding. It may be formed from a rigid material, and can then be readily engaged with the flow directing member by pushing or pressing the two parts together.

As noted above, the flow directing member can be made from a flexible resilient material, and may hold the parts coupled to it, namely the housing 42, the atomizer 70 and the enclosure 80, by friction fit. Since these parts may be more rigid, the flexibility of the flow directing member, which enables it to deform somewhat when pressed against these other parts, accommodates any minor errors in the manufactured size of the parts. In this way, the flow directing part can absorb manufacturing tolerances of all the parts while still enabling quality assembly of the parts altogether to form the cartomizer 40. Manufacturing requirements for making the housing 42, the atomizer 70 and the enclosure 80 can therefore be relaxed somewhat, reducing manufacturing costs.

Figure 3:
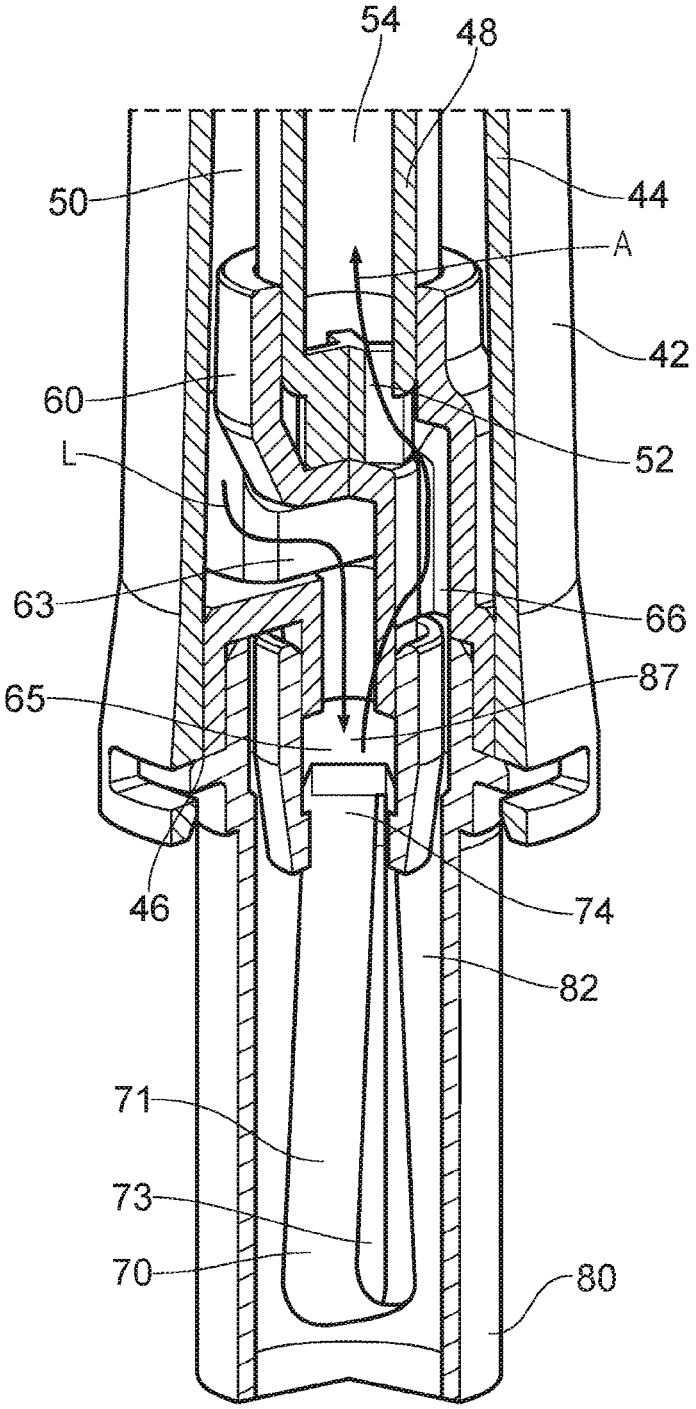
FIG. 3 shows a partially cut-away perspective view of the cartomizer of FIG. 2 in an assembled arrangement.

FIG. 3 shows a cut-away perspective view of the cartomizer of FIG. 1 in an assembled configuration. For clarity, the flow directing member 60 is shaded. It can be seen how the flow directing member 60 is shaped on its upper surfaces to engage around the opening 52 defined by the lower edge of the inner wall 48 of the reservoir housing 42, and concentrically outwardly to engage in the opening 46 defined by the lower edge of the outer wall 44 of the housing 42, in order to seal both reservoir space 50 and the air flow passage 54.

The flow directing member 60 has a liquid flow channel 63 which allows the flow of liquid L from the reservoir volume 50 through the flow directing member into a space or volume 65 under the flow directing member 60. Also, there is an aerosol flow channel 66 which allows the flow of aerosol and air A from the space 65 through the flow directing member 60 to the air flow passage 54.

The enclosure 80 is shaped at its upper rim to engage with corresponding shaped parts in the lower surface of the flow directing member 60, to create the aerosol chamber 82 substantially outside the exterior dimensions of the volume of the reservoir 50 according to the reservoir housing 42. In this example, the enclosure 80 has an aperture 87 in its upper end proximate the flow directing member 60. This coincides with the space 65 with which the liquid flow channel 63 and the aerosol flow channel 66 communicate, and hence allows liquid to enter the aerosol chamber 82 and aerosol to leave the aerosol chamber 82 via the channels in the flow directing member 60.

In this example, the aperture 87 also acts as a socket for mounting the first, supported, end 74 of the atomizer 70 (recall that in the FIG. 2 description, the atomizer socket was mentioned as being formed in the flow directing member, either option can be used). Thus, liquid arriving through the liquid flow channel 63 is fed directly to the first end of the atomizer 70 for absorption and wicking, and air/aerosol can be drawn through and past the atomizer to enter the aerosol flow channel 66.

In this example, the atomizer 70 comprises a planar elongate portion of metal 71 which is folded or curved at its midpoint to bring the two ends of the metal portion adjacent to one another at the first end of the atomizer 74. This acts as the heater component of the atomizer 70. A portion of cotton or other porous material 73 is sandwiched between the two folded sides of the metal portion. This acts as the wicking component of the atomizer 70. Liquid arriving in the space 65 is collected by the absorbency of the porous wick material 73 and carried downwards to the heater. Many other arrangements of an elongate atomizer suitable for cantilevered mounting are also possible and may be used instead.

The heater component is intended for heating via induction, which will be described further below.

The example of FIGS. 2 and 3 has parts with substantially circular symmetry in a plane orthogonal to the longitudinal dimension of the assembled cartomizer. Hence, the parts are free from any required orientation in the planes in which they are joined together, which can give ease of manufacture. The parts can be assembled together in any orientation about the axis of the longitudinal dimension, so there is no requirement to place the parts in a particular orientation before assembly. This is not essential, however, and the parts may be alternatively shaped.

Figure 4:
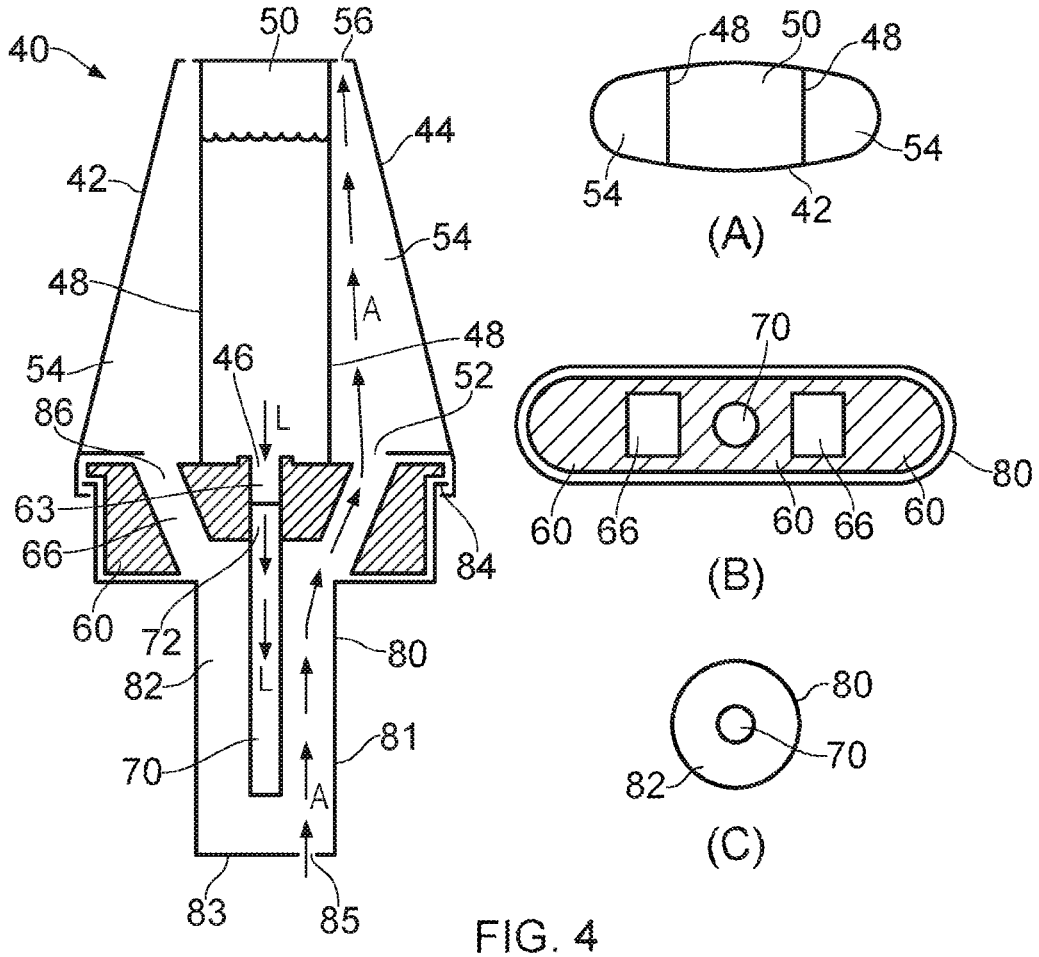

FIG. 4 shows a cross-sectional view through a further example assembled cartomizer comprising a reservoir housing, a flow directing member, an atomizer and an enclosure, as before. In this example, though, in the plane orthogonal to the longitudinal axis of the cartomiser 40, at least some of the parts have an oval shape instead of a circular shape, and are arranged to have symmetry along the major axis and the minor axis of the oval. Features are reflected on either side of the major axis and on either side of the minor axis. This means that for assembly the parts can have either of two orientations, rotated from each other by 180° about the longitudinal axis. Again, assembly is simplified compared to a system comprising parts with no symmetry.

In this example, the enclosure 80 again comprises a side wall 81, which is formed so as to have a varying cross-section at different points along the longitudinal axis of the enclosure, and a base wall 83, which bound a space that creates the aerosol chamber 82. Towards its upper end, the enclosure broadens out to a large cross-section to give room to accommodate the flow directing member 60. The large cross-section portion of the enclosure 80 has a generally oval cross-section (see FIG. 4(B)), while the narrower cross-section portion of the enclosure has a generally circular cross-section (see FIG. 4(C)). The enclosure's upper rim 84, around the top opening 86, is shaped to engage with corresponding shaping on the reservoir housing 42. This shaping and engagement is shown in simplified form in FIG. 4; in reality it is likely to be more complex in order to provide a reasonably air-tight and liquid-tight join. The enclosure 80 has at least one opening 85, in this case in the base wall 83, to allow air to enter the aerosol chamber during user inhalation.

The reservoir housing 42 is differently shaped compared with the FIGS. 2 and 3 example. The outer wall 44 defines an interior space which is divided into three regions by two inner walls 48. The regions are arranged side by side. The central region, between the two inner walls 48 is the reservoir volume 50 for holding liquid. This region is closed at the top by a top wall of the housing. An opening 46 in the base of the reservoir volume allows liquid to be delivered from the reservoir 50 to the aerosol chamber 82. The two side regions, between the outer wall 44 and the inner walls 48, are the air flow passages 54. Each has an opening 52 at its lower end for aerosol to enter, and a mouthpiece opening 56 at its upper end (as before, a separate mouthpiece portion might be added externally to the reservoir housing 42).

A flow directing member 60 (shaded for clarity) is engaged into the lower edge of the housing 42, via shaped portions to engage with the openings 46 and 52 in the housing 42 to close/seal the reservoir volume 50 and the air flow passages 54. The flow directing member 60 has a single centrally disposed liquid flow channel 63 aligned with the reservoir volume opening 46 to transport liquid L from the reservoir to the aerosol chamber 82. Further, there are two aerosol flow channels 66, each running from an inlet at the aerosol chamber 82 to an outlet to the air flow passages 54, by which air entering the aerosol chamber through the hole 85 and collecting vapour in the aerosol chamber 82 flows into the air flow passages 54 to the mouthpiece outlets 56.

The atomizer 70 is mounted by insertion of its first end 72 into the liquid flow channel 63 of the flow directing component 60. Hence, in this example, the liquid flow channel 63 acts as a socket for the cantilevered mounting of the atomizer 70. The first end 72 of the atomizer 70 is thus directly fed with liquid entering the liquid flow channel 60 from the reservoir 50, and the liquid is taken up via the porous properties of the atomizer 70 and drawn along the atomizer length to be heated by the heater portion of the atomizer 70 (not shown) which is located in the aerosol chamber 70.

FIGS. 4(A), (B) and (C) show cross-sections through the cartomizer 40 at the corresponding positions along the longitudinal axis of the cartomizer 40.

While aspects of the disclosure are relevant to atomizers in which the heating aspect is implemented via resistive heating, which requires electrical connections to be made to a heating element for the passage of current, the design of the cartomizer has particular relevance to the use of induction heating. This is a process by which a electrically conducting item, typically made from metal, is heated by electromagnetic induction via eddy currents flowing in the item which generates heat. An induction coil (work coil) operates as an electromagnet when a high-frequency alternating current from an oscillator is passed through it; this produces a magnetic field. When the conducting item is placed in the flux of the magnetic field, the field penetrates the item and induces electric eddy currents. These flow in the item, and generate heat according to current flow against the electrical resistance of the item via Joule heating, in the same manner as heat is produced in a resistive electrical heating element by the direct supply of current. An attractive feature of induction heating is that no electrical connection to the conducting item is needed; the requirement instead is that a sufficient magnetic flux density is created in the region occupied by the item. In the context of vapour provision systems, where heat generation is required in the vicinity of liquid, this is beneficial since a more effective separation of liquid and electrical current can be effected. Assuming no other electrically powered items are placed in a cartomizer, there is no need for any electrical connection between a cartomizer and its power section, and a more effective liquid barrier can be provided by the cartomizer wall, reducing the likelihood of leakage.

Induction heating is effective for the direct heating of an electrically conductive item, as described above, but can also be used to indirectly heat non-conducting items. In a vapour provision system, the need is to provide heat to liquid in the porous wicking part of the atomizer in order to cause vaporisation. For indirect heating via induction, the electrically conducting item is placed adjacent to or in contact with the item in which heating is required, and between the work coil and the item to be heated. The work coil heats the conducting item directly by induction heating, and heat is transferred by thermal radiation or thermal conduction to the non-conducting item. In this arrangement, the conducting item is termed a susceptor. Hence, in an atomizer, the heating component can be provided by an electrically conductive material (typically metal) which is used as an induction susceptor to transfer heat energy to a porous part of the atomizer.

Figure 5:
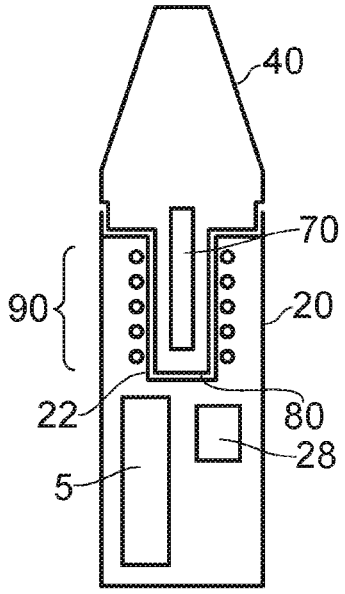
FIG. 5 shows a highly schematic cross-sectional view of a first example vapour provision system employing induction heating in which aspects of the disclosure can be implemented.

FIG. 5 shows a highly simplified schematic representation of a vapour provision system comprising a cartomizer 40 according to examples of the present disclosure and a power component 20 configured for induction heating. The cartomizer 40 may be as shown in the examples of FIGS. 2, 3 and 4 (although other arrangements are not excluded), and is shown in outline only for simplicity. The cartomizer 40 comprises an atomizer 70 in which the heating is achieved by induction heating so that the heating function is provided by a susceptor (not shown). The atomizer 70 is located in the lower part of the cartomizer 40, surrounded by the enclosure 80, which acts not only to define an aerosol chamber but also to provide a degree of protection for the atomizer 70, which could be relatively vulnerable to damage owing to its cantilevered mounting. The cantilever mounting of the atomizer 70 enables effective induction heating however, because the atomizer 70 can be inserted into the inner space of a coil 90, and in particular, the reservoir is positioned away from the inner space of the work coil 90. Hence, the power component 20 comprises a recess 22 into which the enclosure 80 of the cartomizer 40 is received when the cartomizer 40 is coupled to the power component for use (via a friction fit, a clipping action, a screw thread, or a magnetic catch, for example). An induction work coil 90 is located in the power component 20 so as to surround the recess 22, the coil 90 having a longitudinal axis over which the individual turns of the coil extend and a length which substantially matches the length of the susceptor so that the coil 90 and the susceptor overlap when the cartomizer 40 and the power component 20 are joined. In other implementations, the length of the coil may not substantially match the length of the susceptor, e.g., the length of the susceptor may be shorter than the length of the coil, or the length of the susceptor may be longer than the length of the coil. In this way, the susceptor is located within the magnetic field generated by the coil 90. If the items are located so that the separation of the susceptor from the surrounding coil is minimised, the flux experienced by the susceptor can be higher and the heating effect made more efficient. However, the separation is set at least in part by the width of the aerosol chamber formed by the enclosure 80, which needs to be sized to allow adequate air flow over the atomizer and to avoid liquid droplet entrapment. Hence, these two requirements need to be balanced against one another when determining the sizing and positioning of the various items.

The power component 20 comprises a battery 5 for the supply of electrical power to energise the coil 90 at an appropriate AC frequency. Also, there is included a controller 28 to control the power supply when vapour generation is required, and possibly to provide other control functions for the vapour provision system which are not considered further here. The power component may also include other parts, which are not shown and which are not relevant to the present discussion.

The FIG. 5 example is a linearly arranged system, in which the power component 20 and the cartomizer 40 are coupled end-to-end to achieve a pen-like shape.

Figure 6:
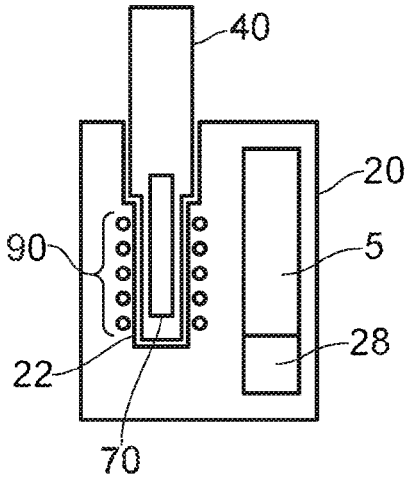
FIG. 6 shows a highly schematic cross-sectional view of a second example vapour provision system employing induction heating in which aspects of the disclosure can be implemented.

FIG. 6 shows a simplified schematic representation of an alternative design, in which the cartomizer 40 provides a mouthpiece for a more box-like arrangement, in which the battery 5 is disposed in the power component 20 to one side of the cartomizer 40. Other arrangements are also possible.

The enclosure 80 is included in the cartomizer to perform a range of functions. These include protection of the atomizer 70, which is potentially vulnerable to damage owing to its cantilevered mounting used to improve the induction coupling between the atomizer 70 and the induction work coil of the vapour provision system. The enclosure also partly or wholly defines an aerosol chamber around the atomizer, in which an aerosol is formed based on the vaporisation of liquid by the atomizer and the flow of incoming air through the enclosure. If the enclosure is wholly or partly closed at its lower end (by an end wall for example), it can act as a sump to collect liquid. This can reduce leakage of free liquid out of the cartomizer in the event that any liquid escapes from the reservoir without being taken up by the porous part of the atomizer, or if free liquid forms in the aerosol chamber from condensation of vapour.

The enclosure can include any of a range of features relevant to the performance of these and other functions.

As described above, the enclosure can have shaped features on its upper rim that engage with correspondingly shaped features on another part of the cartomizer, in particular the reservoir housing or the flow directing member, or possibly both of these parts. For example, the enclosure may have one or more flanges or similar protruding features which fit into similarly shaped and sized recesses on the housing or the flow directing member, or vice versa, so that the two parts can be pushed together in a snap-fit arrangement. Alternatively, if the engaging regions have a circular cross-section, the parts could be joined by a screw-thread, but this is less attractive from the point of view of ease of assembly during cartomizer manufacture.

It may be desirable to inhibit a user from refilling the reservoir once the liquid has been consumed for the purpose of reusing the cartomizer. This can be for reasons of safety, for example. Accordingly, in some examples, the shaped features by which the enclosure is coupled to, engaged with or otherwise attached to the reservoir housing or the flow directing member can be configured to prevent such reuse. In other words, the shaping is configured either to prevent the enclosure from being easily removed after it has been coupled to the rest of the cartomizer during manufacture, or to prevent the enclosure from being rejoined to the rest of the cartomizer if a user succeeds in removing it, or both. For example, the cooperating shaped features may be shaped to easily enable the parts to be pushed together, but not to allow them to be pulled apart. For example, shaping may be sloped inwardly in the connecting direction, but include barbed features which act against pulling in the outward, separating direction. Alternatively or additionally, the shaping may be configured such that the shaped features break, snap, fracture, distort or are otherwise damaged under a pulling force exerted in an attempt to separate the enclosure from the rest of the cartomizer, so that the enclosure cannot be reconnected. Especially thinned or otherwise fragile portions may be included in the shaped features to promote structural failure of this kind.

Figure 7:
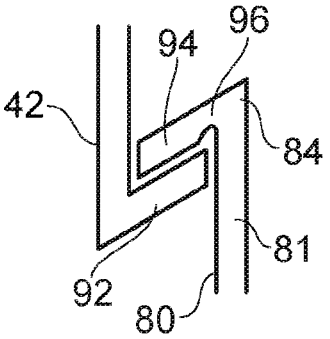
FIG. 7 shows a highly schematic cross-sectional view of part of an atomizer enclosure and a reservoir housing of a cartomizer coupled together by a first example arrangement.

FIG. 7 shows a simplified cross-sectional view of part of an enclosure coupled to a reservoir housing via a cooperating join shaped for breakage to prevent reuse. The reservoir housing 42 has at its lower edge an inwardly and upwardly sloping shaped engagement flange 92. The enclosure 80 has at its upper edge or rim 84 a downwardly and outwardly sloping engagement flange 94. The materials of the two flanges 42, 80 are such as to allow slight flexing so that the engagement flanges 92, 94 can deform enough to slide over one another and snap back into position when the enclosure 80 is pushed onto or into the reservoir housing 42, thereby connecting or coupling the enclosure 80 to the housing 42. The slope of the engagement flanges 92, 94 acts to resist outwardly pulling to separate the enclosure 80 from the reservoir housing 42, so the two parts are effectively locked together. Moreover the engagement flange 94 of the enclosure has a region 96 between the engagement flange 94 and the main side wall 81 of the enclosure 80 which is thinner than the adjacent regions, such that under the action of pulling to remove the enclosure 80, this thinner region 96 will break or fracture under sufficient separating force, so that the engagement portion 94 is separated from the enclosure wall 81 and the enclosure cannot be rejoined or recoupled to the reservoir 42 once it has been uncoupled.

As an alternative to prevent reuse and refilling, in other words to provide a tamper-proof cartomizer, the enclosure may be permanently joined to the reservoir housing or the flow directing member by gluing with adhesive or by welding (ultrasonic welding or laser welding, for example), depending on the materials used for the various parts. This will prevent easy removal of the enclosure so that access to the interior of the reservoir for the purpose of refilling is also prevented.

Figure 8:
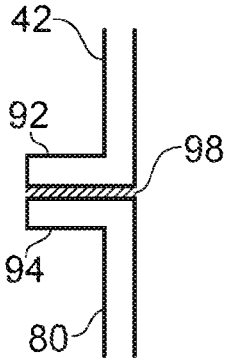
FIG. 8 shows a highly schematic cross-sectional view of part of an atomizer enclosure and a reservoir housing of a cartomizer coupled together by a second example arrangement.

FIG. 8 shows a simplified cross-sectional view of part of an enclosure coupled to a reservoir housing via a permanent join to prevent reuse. Each of the reservoir housing 42 and the enclosure 80 has a flange 92, 94 for joining, as before. However, in this case the flanges 92, 94 do not interlock as in the FIG. 7 example. Rather, they are shaped to each have a flat surface which abuts the flat surface of the other flange when the enclosure 80 and the reservoir housing 42 are brought together. Adhesive can be applied to one or both flat surfaces, or welding can be applied to fuse the flat surfaces together, in order to create a bond 98 between the two parts which inhibits removal of the enclosure 80 from the cartomizer.

It will be clear that any shaped parts included to enable joining of the enclosure can be shaped otherwise than in the examples of FIGS. 7 and 8 in order to achieve the same or similar effects.

In these various examples, the enclosure is a separate component distinct from the reservoir housing, and the two are coupled together during manufacture of the cartomizer. This is not essential however, and the enclosure can alternatively be integrally formed with the reservoir housing (or optionally with the flow directing member), for example by injection moulding of a suitably shaped component.

The manufacturing of the cartomizer by the assembling of the various parts together requires the insertion of the first end of the atomizer into the socket to achieve the cantilevered mounting. Accordingly, in configurations where the enclosure is integrally formed with another part of the cartomizer, the outer wall of the enclosure requires an aperture large enough to allow the atomizer to be mounted. The enclosure cannot be largely or fully closed by the side wall and the base wall as in the examples of FIGS. 3 and 4, since this does not permit access for mounting the atomizer. Also, the flow directing member needs to be included. To enable the atomizer mounting, the enclosure may lack a base wall, for example.

Figure 9:
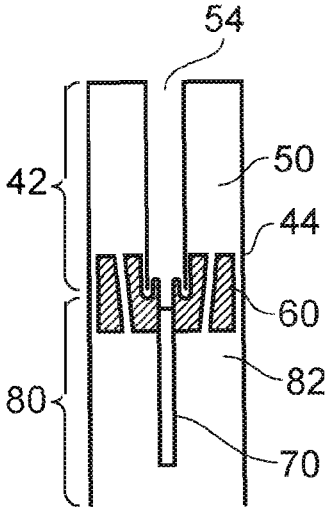
FIG. 9 shows a highly schematic cross-sectional side view of a cartomizer with an integrally formed atomizer enclosure according to an example.

FIG. 9 shows a schematic cross-sectional view of an example cartomizer in which the enclosure is integrally formed. The reservoir housing 42 is as in the FIG. 3 example, with an annular reservoir 50 around a central air flow passage 54. However, the outer side wall 44 of the reservoir housing 42 extends downwardly past the location where the flow directing member 60 is inserted to seal the base of the reservoir 50 and the air flow passage 54. The downward extension can be considered to form the enclosure 80 in this implementation, which is open at the base, but surrounds the atomizer 70 mounted in the flow directing member 60. The enclosure 80 has the form of a skirt portion depending from the base edge of the reservoir housing 42. The enclosure 80 shaped like this still acts to define an aerosol chamber 82 around the atomizer 70, and a lower boundary for the aerosol chamber can be defined by a recess in a power component into which the cartomizer is inserted, as in the FIGS. 5 and 6 examples. In further implementations, the housing 42 may extend downwardly as shown in FIG. 9, but a separate enclosure 80, e.g., such as that shown in FIG. 4, can be coupled to an inner wall of the housing 42. The inner wall may have a corresponding engagement portion to enable engagement of the separate enclosure 80. The extended walls 42 of the reservoir housing may offer protection to the separate enclosure 80 or prevent a user easily accessing the separate enclosure 80 (such as by gripping the bottom part of the enclosure 80 with their fingers). Further, the extended reservoir housing may provide a more visually appealing [[and/or]] or familiar appearance to the cartomizer 40. In implementations having an extended reservoir housing 42, the power section 20 may have a recessed portion on its outer surface corresponding broadly to a location of the coil 90, such that when the cartomizer 40 and the power section are coupled, the housing of the power section and the extended reservoir housing form a flush connection.

Hence, there is a variety of ways in which the enclosure can be connected or joined to the reservoir housing in order to extend outwardly from the exterior boundary of the reservoir to surround the atomizer. The part of the enclosure adjacent to the reservoir housing and by which the extending relationship is enabled or in which the extending relationship is embodied can be referred to as a joining portion, and as discussed, this may be an integral join or a join between separate components, which in turn can be a single-use join or a multiple use join.

As described above, in particular with reference to the FIG. 3 example, the enclosure may include the socket into which the atomizer is inserted. Alternatively, the socket may be formed in the flow directing member, which is in turn appropriately located with respect to the enclosure for the cantilevered positioning of the atomizer. The socket supports the atomizer, so the component or part of a component in which the socket is defined can be considered to be a support portion. Hence, the support portion can be comprised in the enclosure in that it is integrally formed with the enclosure, or it can be a separate component such as the flow directing member which is coupled to the enclosure or to the housing.

In order to enable the required air flow through the cartomizer, by which air travels over and past the atomizer and gathers the generated vapour to form an aerosol for delivery to the user via the air flow passage out of the cartomizer, it is necessary for air to enter the aerosol chamber as defined by the enclosure. Accordingly, the enclosure should not create an airtight environment when it is coupled to the reservoir housing. At least one aperture should be present in the wall or walls of the enclosure through which air is drawn into the interior of the enclosure when a user inhales through the mouthpiece outlet of the cartomizer. There is a number of ways in which an air inlet aperture can be provided.

In the example of FIG. 9, the enclosure as formed integrally with the reservoir housing lacks a base wall so that the atomizer and the flow directing member can be positioned inside the cartomizer. Accordingly, the absence of the base wall forms a large aperture in the enclosure wall for air intake. This approach may also be used in examples where the enclosure is a separate component coupled to the reservoir housing; an open base is not limited to an integrally formed enclosure.

In examples where the enclosure has a base wall, apertures may be present in the base wall. The base wall is an effective location for air intake since it allows air to flow past the full longitudinal extent of the atomizer so that a maximum amount of vapour is collected.

Figure 10:
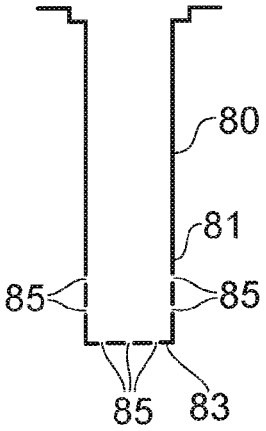
FIG. 10 shows a schematic cross-sectional side view of an atomizer enclosure with air intake apertures according to an example.

FIG. 10 shows a cross-sectional side view of an enclosure 80 comprising three holes or apertures 85 in the base wall 83. Any number of apertures can be included in the base wall; for example the FIG. 4 example has a single aperture 85. Alternatively or additionally, apertures 85 can be provided in the side wall 81 of the enclosure 80, also as shown in FIG. 10. Locating the apertures 85 at or towards the lower part of the side wall 81 allows the indrawn air to have a long path through the aerosol chamber to maximise gathering of vapour.

If the enclosure lacks a base wall, or has apertures of a significant size (namely a size that allows liquid to readily flow through the apertures) in its base wall or side wall, the enclosure is able to leak any free liquid that finds its way into the enclosure, either from the reservoir or from condensation of vapour/aerosol. In order to reduce such leakage, the apertures may be differently configured.

For example, the apertures in the enclosure wall(s) may be made sufficiently small so as to be permeable to air in order to allow an inward flow of air, but substantially impermeable to liquid in order to inhibit an outward flow of liquid (which represents a liquid leak). The impermeability arises from surface tension in the liquid. An appropriate aperture size for the enclosure wall(s) will therefore depend on factors including the viscosity of the liquid with which the reservoir is filled. In general, the apertures may be made smaller than the capillarity length of the liquid when it is in use in the cartomizer. A thicker or more viscous liquid can be paired with larger apertures, so that fewer apertures are needed for a given air intake. A thinner or less viscous liquid will need to be paired with smaller apertures, so that more apertures may be needed for an adequate level of air intake. Small apertures in the enclosure wall(s) may therefore be provided as a plurality of apertures, and may be considered as perforations. The apertures may be distributed evenly over the walls of the enclosure, or might be concentrated towards the base, similarly to the larger openings shown in FIG. 10.

Additionally, small apertures may be made more impermeable to liquid by being coated with a hydrophobic material. In this way, liquid is repelled from the apertures and does not leak through the apertures. The apertures are also kept free from the presence of liquid so that air can enter and the required level of air intake is maintained.

As an alternative, an aperture or apertures may be made permeable to air and substantially impermeable to liquid by being provided with a valve operable to open to let air flow into the enclosure but to remain closed against the outward flow of liquid. This is straightforward to implement in the context of a cartomizer since an inhalation on a vapour provision system draws air in the required inward direction. Hence, when a user inhales, the air pressure inside the enclosure will drop and become lower than the air pressure outside the enclosure, and the valve will open in response to this pressure difference, allowing air to be pulled into the lower pressure interior of the enclosure. In contrast, the amount of liquid that may accumulate inside the enclosure will be small so that there is insufficient pressure inside the enclosure to cause the valve to open outwardly to let liquid out as a leak. Nevertheless, it may be desired to utilise a one-way valve that is configured to be unable to open in the outward direction in order to prevent the expulsion of liquid from the enclosure in the event that a user blows into the cartomizer rather than inhaling.

Any suitable style of valve may be used for this purpose. However, in order to maintain ease of manufacture and simplicity of structure, a valve may be provided in the base wall of the enclosure by fabricating the base wall from an elastomeric material (elastomer), and cutting a valve into it. The valve may be a simple cross shape comprising two intersecting cuts, for example.

Figure 11:
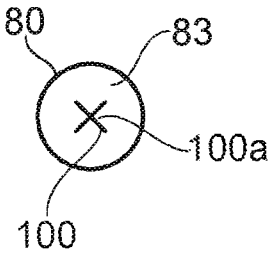
FIG. 11 shows a plan base view of an atomizer enclosure with an air intake valve according to an example.

FIG. 11 shows a plan view of an enclosure 80 viewed from below, and having a valve 100 cut into the base wall. The segments 100*a* of the valve 100 are able to deform owing the flexibility of the elastomeric material so that air is drawn inwards under user inhalation. The pressure of any free liquid that may accumulate inside the enclosure will be insufficient to open the valve outwards to allow the liquid to escape, however.

In configurations of the enclosure in which the lower part is effectively closed to the egress of liquid (solid base wall, valve in the base wall, apertures impermeable to liquid flow, for example), the enclosure can be considered to perform the function of a sump. It can collect any free liquid in its lower part and keep this from escaping outwardly from the cartomizer. In this way, overall leakage from the cartomizer and the vapour provision system in which the cartomizer is used can be reduced, and liquid can be inhibited from finding its way into the power component where it could damage the electrical components of the vapour provision system.

A further approach to minimising liquid leakage from a cartomizer relates to leakage that may arise before use of the cartomizer, during the period between filling of the reservoir in manufacture and coupling of the cartomizer with a power component for use in aerosol provision. Assuming that the joins between the various parts of the cartomizer are made substantially leak-proof, the cartomizer has openings vulnerable to liquid egress at the mouthpiece outlet and at any apertures in the enclosure as described above. In order to reduce leakage prior to use, the cartomizer may be provided with seals or the like which cover one or more openings or apertures and which are removable by the user prior to use of the cartomizer.

Figure 12:
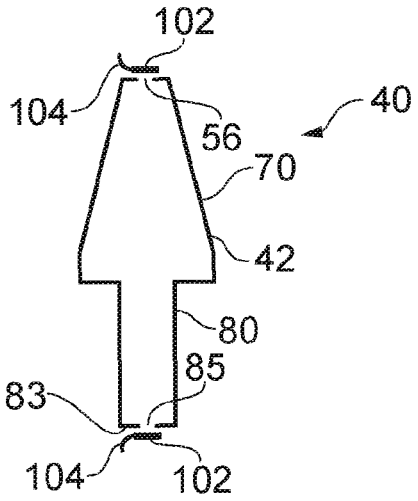
FIG. 12 shows a highly simplified schematic cross-sectional side view of a cartomizer with sealing layers according to a first example.

FIG. 12 shows a highly simplified and schematic cross-sectional side view of an example cartomizer with seals of this type. The cartomizer 40 has a mouthpiece outlet 56 at the upper end of the reservoir housing 42, and an aperture 85 for air intake in the base wall 83 of the enclosure 80. Each of these openings is provided with a removable sealing layer 102, for example in the form of a peelable adhesive label, that can be removed by the user. For example each sealing layer 102 may have a pull tab, tear tab, tear strip or pull strip 104 of the like by which the sealing layer 102 may be gripped and pulled for removal. The same arrangement can be adopted for apertures 85 in other locations on the enclosure 80. If more than one aperture 85 is provided, a separate sealing layer 102 may be provided for each. Alternatively, a sealing layer may be provided over fewer than all of the outlet and the apertures, for example over the enclosure apertures only. In examples where more than one sealing layer is included, a common pull tab/tear strip shared by all the sealing layers may be used, by which all the sealing layers can be removed via a single pulling action.

Figure 13:
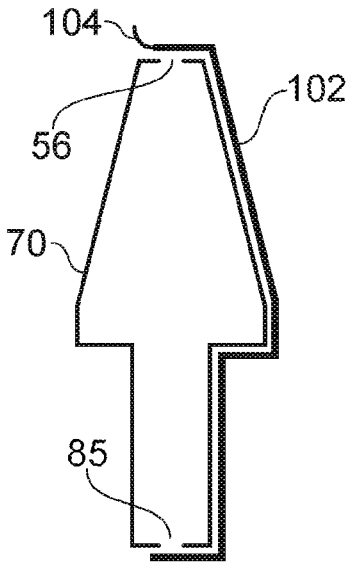
FIG. 13 shows a highly simplified schematic cross-sectional side view of a cartomizer with a sealing layer according to another example.

FIG. 13 shows a highly simplified and schematic cross-sectional side view of an example cartomizer with an alternative sealing arrangement. In this example, a single sealing layer 102 with a pull tab 104 covers both the enclosure aperture 85 and the mouthpiece outlet 56 (and is adhered to the intermediate parts of the cartomizer surface). Thus, all openings can be uncovered for use by removal of a single sealing layer, which may be more convenient for the user, and ensures that the cartomizer is properly prepared for use in that it is not possible to remove fewer than all the seals.

Sealing layers without pull tabs may be used if preferred.

As described, during use of the vapour provision system for aerosol production, air is drawn into the enclosure to collect vapour generated by the atomizer in the aerosol chamber to entrain the vapour in the flow of air for delivery of aerosol to the mouthpiece outlet. The gathering of vapour by the flowing air and the formation of aerosol can be improved if the air flow is less smooth.

Figure 14:
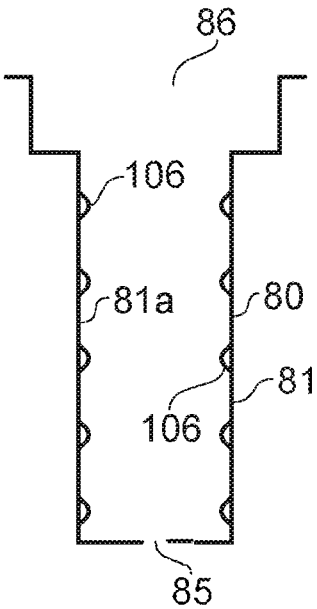
FIG. 14 shows a schematic cross-sectional side view of an atomizer enclosure with interior surface patterning according to an example.

FIG. 14 shows a simplified schematic side view of an enclosure configured for improved aerosol formation via a perturbed air flow. The enclosure 80 may be according to any previous example or otherwise configured in accordance with the features described herein. As before, it has an outer side wall 81. In this example the inner surface 81*a* of the outer side wall 81 is provided with surface features 106 in the form of bumps, ridges, protrusions or other surface patterning that breaks up the inner surface 81*a* and prevents it from being smooth. The presence of the surface patterning disrupts or otherwise interferes with the flow of air between the aperture(s) 85 and the opening 86 by which aerosol exits the aerosol chamber. In this way, some turbulence or similar perturbation is introduced to the air flow. This increases the interaction of the air with the vapour in the aerosol chamber, for enhancement of the aerosol production. The surface features 106 should be sized with regard to having an appreciable effect on the air flow while also keeping a sufficient spacing between the atomizer and the inner surface 91*a* so that liquid droplets are free to move with the flowing air. Alternatively, or additionally, the atomizer itself may have surface features in the form of bumps, ridges, protrusions or other surface patterning that breaks up the surface of the susceptor. The flow of air is broadly between the inner surface of the enclosure 81 and the outer surface of the atomizer comprising a susceptor (heater) [[and/or]] or porous (wicking) material, and hence any or all of these components may include features that impart some turbulence, perturbation or disruption to the airflow as it is being drawn from the lower part of the enclosure past the atomizer. Such surface features can be considered to be flow disrupting features.

Hence, an example implementation provides a cartridge or cartomizer for a vapour provision system comprising: an elongate atomizer for vaporising aerosolizable substrate material; an enclosure at least partially surrounding the elongate atomizer to define an aerosol chamber around the atomizer; an airflow path through the aerosol chamber which is defined between an inner surface of the enclosure and an outer surface of the elongate atomizer along at least part of the longitudinal extent of the atomizer; and at least one flow disrupting feature on the inner surface of the enclosure or the outer surface of the elongate atomizer configured to perturb the flow of air along the airflow path.

In conclusion, in order to address various issues and advance the art, this disclosure shows by way of illustration various embodiments in which the disclosure may be practiced. The advantages and features of the disclosure are of a representative sample of embodiments only, and are not exhaustive or exclusive. They are presented only to assist in understanding and to teach the disclosed embodiments. It is to be understood that advantages, embodiments, examples, functions, features, structures, or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other embodiments not presently claimed, but which may be claimed in future.

The invention claimed is:

1. A cartridge for a vapor provision system, comprising:

a reservoir for aerosolizable substrate material, the reservoir defined by a housing;

an atomizer for aerosolizing the aerosolizable substrate material from the reservoir, the atomizer located externally to outer dimensions of the reservoir; and an enclosure at least partially surrounding the atomizer to define an aerosol chamber around the atomizer, the enclosure comprising:

at least one wall defining the aerosol chamber, the at least one wall including a side wall defining a central space that creates the aerosol chamber outside the outer dimensions of the reservoir;

a joining portion by which the enclosure is coupled to the housing so as to extend outwardly from the housing;

an opening in the at least one wall to allow aerosolizable substrate material to enter the aerosol chamber from the reservoir and aerosol to exit the aerosol chamber; and one or more apertures in the at least one wall to allow air to enter the aerosol chamber.

2. The cartridge according to claim 1, wherein the joining portion comprises one or more shaped parts for coupling of the enclosure directly or indirectly to the housing.

3. The cartridge according to claim 2, wherein the one or more shaped parts are configured to prevent recoupling of the enclosure to the housing in the event that the enclosure has been uncoupled from the coupled arrangement with the housing.

4. The cartridge according to claim 1, wherein the joining portion is integrally formed with the housing.

5. The cartridge according to claim 1, wherein the enclosure further comprises a support portion for supporting the atomizer in the aerosol chamber.

6. The cartridge according to claim 5, wherein the support portion is at an end of the enclosure where the joining portion extends the enclosure from the housing, to support the atomizer at one of its ends such that the atomizer extends outwardly to an unsupported cantilevered end remote from the reservoir.

7. The cartridge according to claim 5, wherein the support portion is integrally formed with the enclosure.

8. The cartridge according to claim 5, wherein the support portion is a separate component configured to be coupled to the enclosure and/or the housing.

9. The cartridge according to claim 8, wherein the support portion additionally comprises at least one liquid flow channel for the flow of aerosolizable substrate material from the reservoir to the atomizer, and at least one aerosol flow channel for the flow of aerosol derived from the atomizer to an air flow passage.

10. The cartridge according to claim 1, wherein the one or more apertures comprise a plurality of perforations.

11. The cartridge according to claim 1, wherein the at least one wall further includes an end wall of the enclosure remote from the joining portion, and the one or more apertures comprise at least one valve in the end wall operable to open for the flow of air into the aerosol chamber.

12. The cartridge according to claim 11, wherein at least the end wall is formed from an elastomeric material and the valve comprises crossed cuts in the end wall.

13. The cartridge according to claim 1, wherein the at least one wall further includes an end wall of the enclosure remote from the joining portion, and the one or more apertures comprises an opening in the end wall to enable air entering the aerosol chamber to flow over the atomizer.

14. The cartridge according to claim 1, further comprising surface patterning on an inner surface of the at least one wall configured to disrupt the flow of air entering through the one or more apertures.

15. The cartridge according to claim 1, further comprising a removable sealing layer disposed over the one or more apertures and configured for removal by a user before use of the cartridge in a vapor provision system.

16. A vapor provision system, comprising a cartridge according to claim 1.

17. The vapor provision system according to claim 16, further comprising a mouthpiece with an outlet for the inhalation of aerosol formed from the aerosolizable substrate material, a first sealing layer disposed over the one or more apertures of the enclosure, and a second sealing layer disposed over the outlet of the mouthpiece, the sealing layers configured for removal by a user before use of the vapor provision system or the cartridge.

18. The vapor provision system according to claim 17, wherein the first sealing layer and the second sealing layer are a single, shared sealing layer.

19. The vapor provision system according to claim 17, further comprising a shared pull strip or a tear strip configured to enable removal by a user of both the first sealing layer and the second sealing layer.

20. The cartridge according to claim 1, wherein the enclosure is coupled to the housing at the joining portion by a join secured by adhesive or welding.

* * * * *